US010001294B2

(12) United States Patent
Kawai et al.

(10) Patent No.: US 10,001,294 B2
(45) Date of Patent: Jun. 19, 2018

(54) AIR-CONDITIONING APPARATUS

(71) Applicant: Mitsubishi Electric Corporation, Tokyo (JP)

(72) Inventors: Kazuhiko Kawai, Tokyo (JP); Yuki Mochizuki, Tokyo (JP); Yusuke Koyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 27 days.

(21) Appl. No.: 15/320,394

(22) PCT Filed: Jul. 30, 2014

(86) PCT No.: PCT/JP2014/004005

§ 371 (c)(1),
(2) Date: Dec. 20, 2016

(87) PCT Pub. No.: WO2016/016913

PCT Pub. Date: Feb. 4, 2016

(65) Prior Publication Data

US 2017/0191686 A1 Jul. 6, 2017

(51) Int. Cl.
*F24F 11/30* (2018.01)
*F24F 11/61* (2018.01)
(Continued)

(52) U.S. Cl.
CPC ..... *F24F 11/30* (2018.01); *F24F 11/006* (2013.01); *F24F 11/0012* (2013.01);
(Continued)

(58) Field of Classification Search
CPC .. F24F 11/0012; F24F 11/006; F24F 11/0073; F24F 11/0076; F24F 11/30;
(Continued)

(56) References Cited

U.S. PATENT DOCUMENTS 5,467,265 A * 11/1995 Yamada ..... F01K 13/02 700/276
9,080,805 B2 * 7/2015 Yanagida ..... F25B 49/025

FOREIGN PATENT DOCUMENTS

JP 59-071942 A 4/1984
JP 07-167507 A 7/1995
(Continued)

OTHER PUBLICATIONS

International Search Report of the International Searching Authority dated Nov. 4, 2014 for the corresponding International application No. PCT/JP2014/004005 (and English translation).
(Continued)

*Primary Examiner* — Marc Norman
(74) *Attorney, Agent, or Firm* — Posz Law Group, PLC

(57) ABSTRACT

An air-conditioning apparatus prevents a compressor from not starting for a long time when an actual air conditioning load is low or when exhaust heat from heat-generating devices in an air-conditioned indoor space is not returned to an indoor unit, and reduces the number of times the compressor is started and stopped. The air-conditioning apparatus includes a refrigerant circuit sequentially annularly connecting the compressor, a heat source-side heat exchanger, an expansion valve, and a use-side heat exchanger, a blowing temperature sensor detecting a blowing temperature of air brown into the air-conditioned indoor space after passing through the use-side heat exchanger in the indoor unit including the use-side heat exchanger, and a compressor control unit performing thermo-on and thermo-off controls to start and stop the compressor, to approximate the blowing temperature detected by the blowing temperature sensor to a preset temperature. A time for which the next thermo-on control is prohibited is set based on an air-conditioning operation state immediately preceding the thermo-off control or during thermo-off time.

4 Claims, 5 Drawing Sheets

(51) Int. Cl.
*F25B 49/02* (2006.01)
*F24F 11/00* (2018.01)

(52) U.S. Cl.
CPC ..... *F24F 11/0076* (2013.01); *F24F 11/62* (2018.01); *F24F 11/70* (2018.01); *F24F 11/61* (2018.01); *F24F 2011/0073* (2013.01); *F24F 2110/10* (2018.01)

(58) Field of Classification Search
CPC .. F24F 11/61; F24F 11/62; F24F 11/70; F24F 2110/10; F25B 49/022; F25B 2600/0251; F25B 2700/21173
See application file for complete search history.

(56) References Cited

FOREIGN PATENT DOCUMENTS

| | | | |
|---|---|---|---|
| JP | 10-030836 | A | 2/1998 |
| JP | 2004-028458 | A | 1/2004 |

OTHER PUBLICATIONS

Office action dated Oct. 3, 2017 in corresponding JP application No. 2016-537608 (and English translation thereof).

* cited by examiner

AIR-CONDITIONING APPARATUS

CROSS REFERENCE TO RELATED APPLICATIONS

This application is a U.S. national stage application of PCT/JP2014/004005 filed on Jul. 30, 2014, the contents of which are incorporated herein by reference.

TECHNICAL FIELD

The present invention relates to an air-conditioning apparatus that performs thermo-on control and thermo-off control.

BACKGROUND ART

As an example of an air-conditioning apparatus according to related art whose blowing air temperature is controlled, an air-conditioning apparatus has been proposed that includes a stop command unit for stopping a compressor when the temperature of the air blown from an indoor unit becomes lower than a predetermined value, a storing unit for storing the temperature of suction air at the time when the stop command unit stops the compressor, and a start command unit for starting the compressor when the temperature of suction air has risen by a predetermined value from the stored temperature (see, for example, Patent Literature 1). Although the air-conditioning apparatus described in Patent Literature 1 is directed mainly to the control of blowing air temperature, and configured to start the compressor (thermo-on control) based on a rise in suction air temperature, no other unit is suggested.

CITATION LIST

Patent Literature

Patent Literature 1: Japanese Unexamined Patent Application Publication No. 10-30836

SUMMARY OF INVENTION

Technical Problem

The air-conditioning apparatus described in Patent Literature 1 is configured so that, when the blowing air is controlled, the air-conditioning apparatus stores the temperature of suction air at the time when the compressor is stopped, and the subsequent starting of the compressor is performed by the start command unit when a detected suction temperature has risen by a predetermined value or more from the stored suction temperature. This configuration allows the air-conditioning apparatus to minimize the number of compressor starts and stops, without neither being misled by the temperature in the duct nor sacrificing the necessary temperature controllability over the air conditioning load.

However, in the proposed air-conditioning apparatus, when the actual air conditioning load in the air-conditioned indoor space is low or when the exhaust heat generated from heat-generating devices located in the air-conditioned indoor space is not returned to the indoor unit, the temperature of suction air does not rise, and thus the compressor does not start for a long time, with the result that the air at a temperature higher than a preset blowing air temperature continues to be blown out.

The present invention has been made to address the above-mentioned problem, and an object of the present invention is accordingly to provide an air-conditioning apparatus capable of preventing the compressor from not starting for a long time even when the actual air conditioning load is low or even when the exhaust heat generated from heat-generating devices located in the air-conditioned indoor space is not returned to the indoor unit, and reducing the number of times the compressor is started and stopped.

Solution to Problem

An air-conditioning apparatus according to an embodiment of the present invention includes a refrigerant circuit sequentially annularly connecting a compressor, a heat source-side heat exchanger, an expansion valve, and a use-side heat exchanger, a blowing temperature sensor that detects the blowing temperature of air blown out into an air-conditioned indoor space after passing through the use-side heat exchanger in an indoor unit in which the use-side heat exchanger is disposed, and a compressor control unit for performing thermo-on control that starts the compressor, and thermo-off control that stops the compressor, to approximate the blowing temperature detected by the blowing temperature sensor to a preset temperature. The time period for which the next thermo-on control is prohibited is set based on the state of air-conditioning operation immediately preceding the thermo-off control or during thermo-off time. Examples of the "state of air-conditioning operation immediately preceding the thermo-off control or during thermo-off time" mentioned above include the continuous thermo-on time immediately preceding the thermo-off control, the number of compressor starts and stops that have occurred in a predetermined time period, the rate of decrease in blowing temperature in a predetermined time period immediately preceding the thermo-off control, and the rate of increase in suction temperature in a predetermined time period during thermo-off time.

Advantageous Effects of Invention

The air-conditioning apparatus according to the embodiment of the present invention is configured so that, in performing the thermo-on control that starts the compressor or the thermo-off control that stops the compressor to approximate the blowing temperature of the indoor unit to a preset temperature, the time period for which the next thermo-on control is prohibited is set depending on the state of air-conditioning operation immediately preceding the thermo-off control or during thermo-off time. This configuration prevents the compressor from not starting for a long time even when the actual air conditioning load is low or even when the exhaust heat generated from heat-generating devices is not returned to the air-conditioned indoor space, and reduces the number of times the compressor is started and stopped.

DESCRIPTION OF EMBODIMENTS

Embodiment 1

Figure 1:
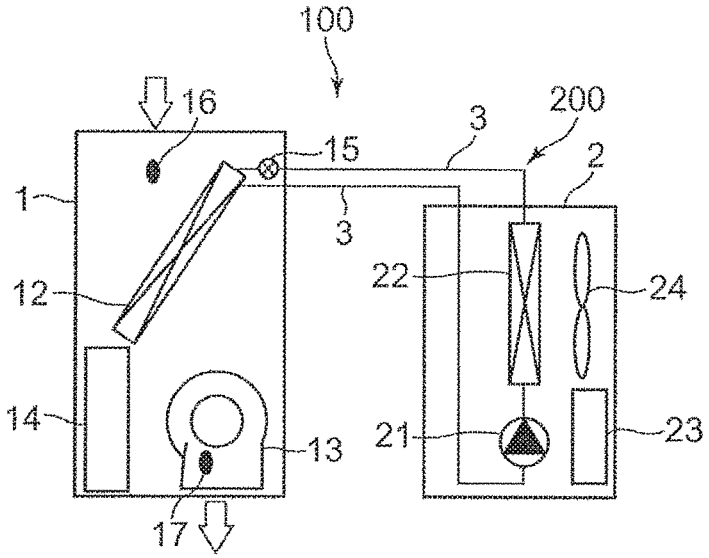
FIG. 1 schematically illustrates an air-conditioning apparatus according to Embodiment 1 of the present invention.

FIG. 1 schematically illustrates an air-conditioning apparatus according to Embodiment 1 of the present invention. The air-conditioning apparatus according to Embodiment 1 will be described below with reference to FIG. 1.

With reference to FIG. 1, an air-conditioning apparatus 100 according to Embodiment 1 includes an indoor unit 1, an outdoor unit 2, and connecting pipes 3 that are used to circulate refrigerant and connect the indoor unit 1 and the outdoor unit 2. A compressor 21 and a heat source-side heat exchanger 22 of the outdoor unit 2, the connecting pipe 3, an expansion valve 15 and a use-side heat exchanger 12 of the indoor unit 1, and the connecting pipe 3 are annularly sequentially connected by pipes to form a refrigerant circuit 200 that performs refrigeration cycle operation.

The indoor unit 1 is installed with the expansion valve 15 and the use-side heat exchanger 12 that are connected in series by pipes. The expansion valve 15 causes refrigerant to expand by reducing its pressure, and is preferably constituted of an electronic expansion valve whose valve opening degree can be variably controlled. The use-side heat exchanger 12 acts as an evaporator in cooling operation, and acts as a condenser in heating operation. An indoor air-sending unit 13 for supplying air to the use-side heat exchanger 12 is disposed in the vicinity of the use-side heat exchanger 12. The indoor air-sending unit 13 is preferably constituted of, for example, a fan such as a centrifugal fan and a multi-blade fan, with the fan rotation speed controlled by an inverter device to control air volume. That is, the use-side heat exchanger 12 allows heat to be exchanged between the air supplied from the indoor air-sending unit 13, and the refrigerant, causing the refrigerant to evaporate and gasify or condense and liquefy. A suction temperature sensor 16 is disposed in the vicinity of the air inlet of the body casing of the indoor unit 1 to detect the suction temperature of the indoor air, and a blowing temperature sensor 17 is disposed in the vicinity of the air outlet to detect the blowing temperature of the conditioned air.

The indoor unit 1 includes an indoor control device 14. The indoor control device 14 includes components such as a CPU, a data bus, an input port and an output port, a non-volatile memory, and a timer that are intended for general purpose use. The indoor control device 14 is configured to perform predetermined controls over settings such as the valve opening degree of the expansion valve 15 and the fan rotation speed of the indoor air-sending unit 13, based on operating information (such as indoor air temperature, preset temperature, and refrigerant pipe temperature). The indoor control device 14 is connected to an outdoor control device 23 described later by a transmission line (not illustrated), and thus capable of transmitting and receiving information data to and from the outdoor control device 23.

The outdoor unit 2 is installed with the compressor 21 and the heat source-side heat exchanger 22 that are connected in series by pipes. The compressor 21 sucks and compresses refrigerant into a high-temperature, high-pressure state. The compressor 21 has its motor rotation speed controlled by, for example, an inverter device to control its capacity. The heat source-side heat exchanger 22 acts as a condenser in cooling operation, and acts as an evaporator in heating operation. An outdoor air-sending unit 24 for supplying air is disposed in the vicinity of the heat source-side heat exchanger 22. The outdoor air-sending unit 24 is constituted of a fan such as a centrifugal fan and a multi-blade fan. The heat source-side heat exchanger 22 allows heat to be exchanged between the air supplied from the outdoor air-sending unit 24, and the refrigerant, causing the refrigerant to evaporate and gasify or condense and liquefy.

The outdoor unit 2 includes the outdoor control device 23. The outdoor control device 23 includes components such as a CPU, a data bus with an input port and an output port, a non-volatile memory, and a timer that are intended for general purpose use. The outdoor control device 23 is configured to perform predetermined controls over settings such as the motor rotation speed of the compressor 21, and the fan rotation speed of the outdoor air-sending unit 24, based on operating information (such as indoor air temperature, preset temperature, and refrigerant pipe temperature) supplied from the indoor unit 1.

Figure 2:
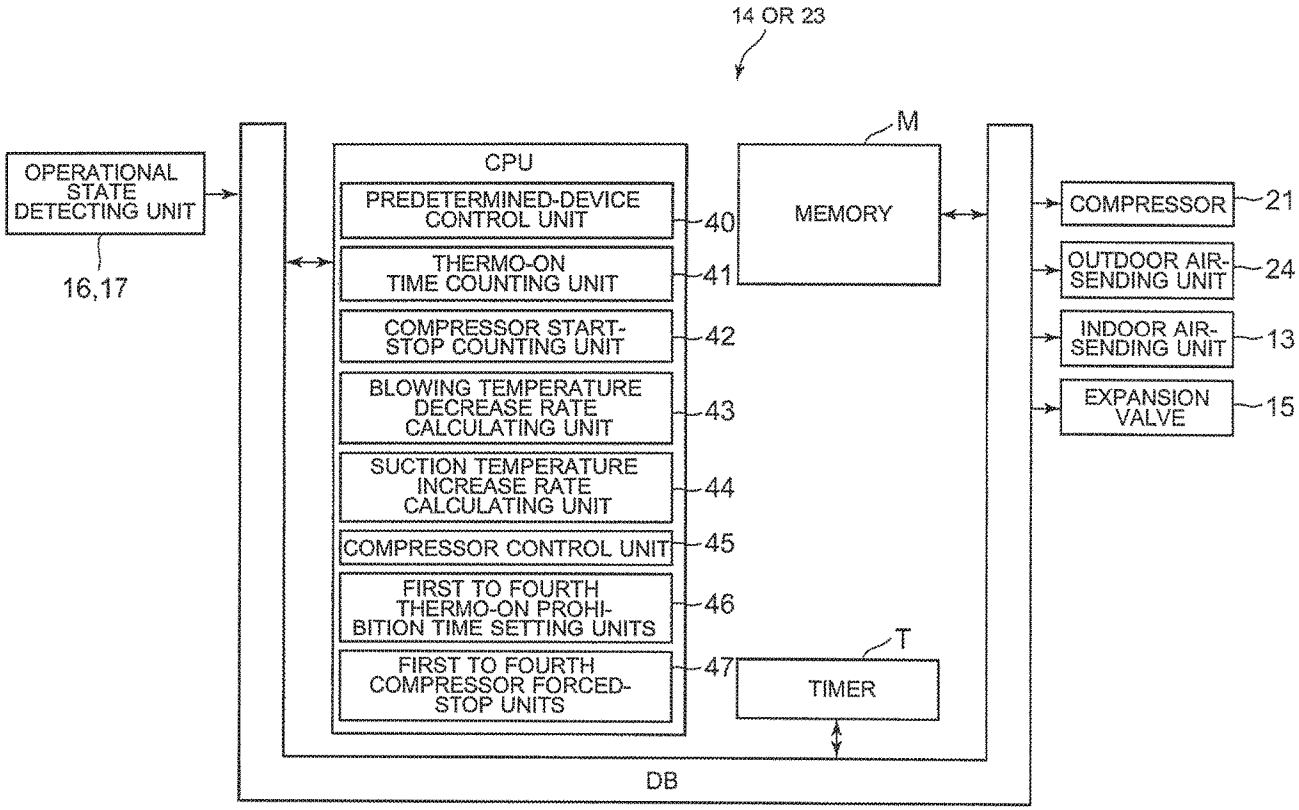
FIG. 2 is a schematic block diagram illustrating a control system of the air-conditioning apparatus.

As illustrated in FIG. 2, the indoor control device 14 of the indoor unit 1, or the outdoor control device 23 of the outdoor unit 2 includes a CPU (central processing unit), a memory M, a timer T, and a data bus DB. These components may be either included only in the indoor control device 14 of the indoor unit 1 or included only in the outdoor control device 23 of the outdoor unit 2. Alternatively, these components may be separately disposed in the indoor control device 14 and the outdoor control device 23. The input port of the data bus DB is connected with an operational state detecting unit such as the suction temperature sensor 16 and the blowing temperature sensor 17. The output port of the data bus DB is connected with drivers that drive components such as the compressor 21, the outdoor air-sending unit 24, the indoor air-sending unit 13, and the expansion valve 15.

The CPU includes the functions of the following components described later as program software: a predetermined-device control unit 40, a thermo-on time counting unit 41, a compressor start-stop counting unit 42, a blowing temperature decrease rate calculating unit 43, a compressor control unit 45, first to fourth thermo-on prohibition time setting units 46, and first to fourth compressor forced-stop units 47. These functions are stored in the memory M in advance as program data and read from the memory M as required and used by the CPU. In the memory M, data related to predetermined time periods, such as 3 minutes, 5 minutes, and 10 minutes, preset temperatures related to the blowing temperature of the indoor unit 1, and other data are stored in advance. The compressor control unit 45 of the CPU performs a "thermo-on" control that starts the compressor 21 or a "thermo-off" control that stops the compressor 21 to approximate the blowing temperature detected by the blowing temperature sensor 17 to a preset temperature.

Next, operation of the air-conditioning apparatus 100 will be described.

The description below will mainly focus on "cooling operation" performed by the air-conditioning apparatus 100. The refrigerant circuit 200 of the air-conditioning apparatus 100 is filled with refrigerant. The predetermined-device control unit 40 of the CPU performs normal operation control related to cooling or heating. With this control, the refrigerant in the refrigerant circuit 200 is turned into a high-temperature, high-pressure state by the compressor 21. The resulting refrigerant is discharged from the compressor 21, and enters the heat source-side heat exchanger 22. When the refrigerant enters the heat source-side heat exchanger 22, the refrigerant exchanges heat with the air supplied from the outdoor air-sending unit 24, causing the refrigerant to condense and liquefy. The refrigerant condensed and liquefied flows through the connecting pipe 3 and enters the expansion valve 15. When the refrigerant enters the expansion valve 15, the refrigerant is reduced in pressure and expands, causing the refrigerant to change state into a low-temperature, low-pressure two-phase gas-liquid refrigerant. The two-phase gas-liquid refrigerant enters the use-side heat exchanger 12. When the refrigerant enters the use-side heat exchanger 12, the refrigerant exchanges heat with the air circulating indoors that is supplied by the indoor air-sending unit 13, causing the refrigerant to evaporate and gasify. The refrigerant evaporated and gasified exits the use-side heat exchanger 12, flows through the connecting pipe 3, and is sucked into the compressor 21 again. The refrigeration cycle operation is repeated in this way.

Meanwhile, the indoor air supplied to the use-side heat exchanger 12 by the indoor air-sending unit 13 is cooled by the heat of evaporation of the refrigerant entering the use-side heat exchanger 12, and then supplied into the target cooling area (the air-conditioned indoor space) in which the indoor unit 1 is placed. As the indoor air cools, for example, the target cooling area and heat-generating devices located in the target cooling area, the indoor air rises in temperature. The indoor air that has risen in temperature is supplied to the use-side heat exchanger 12 of the indoor unit 1 again by the indoor air-sending unit 13, and cooled by the heat of evaporation of the refrigerant. The indoor air is circulated in this way.

Figure 3:
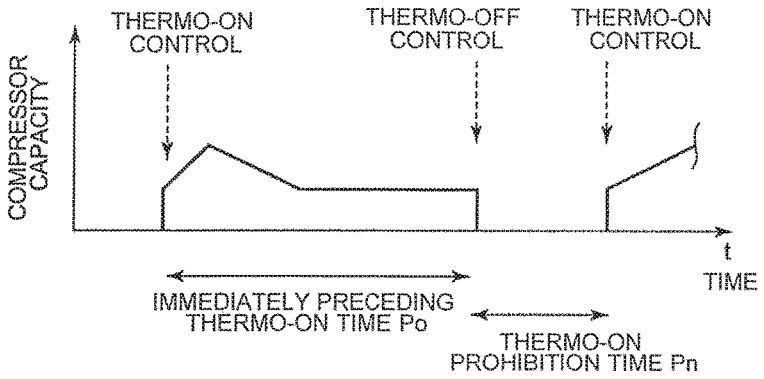
FIG. 3 is a graph illustrating variations in compressor capacity on the time axis, for explaining thermo-on operation and thermo-off operation of the air-conditioning apparatus.

The indoor control device 14 determines the necessity of air-conditioning capacity based on the difference between the suction temperature of the indoor unit 1 or the blowing temperature of the indoor unit 1, and a set temperature corresponding to its target value, and performs thermo-off control that causes the compressor 21 to stop operating. Once the thermo-off control is effected, the indoor control device 14 determines the necessity of air-conditioning capacity based on the difference between the suction temperature of the indoor unit 1 or the blowing temperature of the indoor unit 1, and a set temperature corresponding to its target value, and performs thermo-on control that causes the compressor 21 to start operating. FIG. 3 illustrates variations in the discharge capacity of the compressor 21 over time, representing thermo-on and thermo-off conditions. With reference to FIG. 3, a thermo-on prohibition time Pn during which the compressor 21 is forced not to start (thermo-off condition) is set between the immediately preceding thermo-on time Po, and the time of the next thermo-on control (start).

Figure 4:
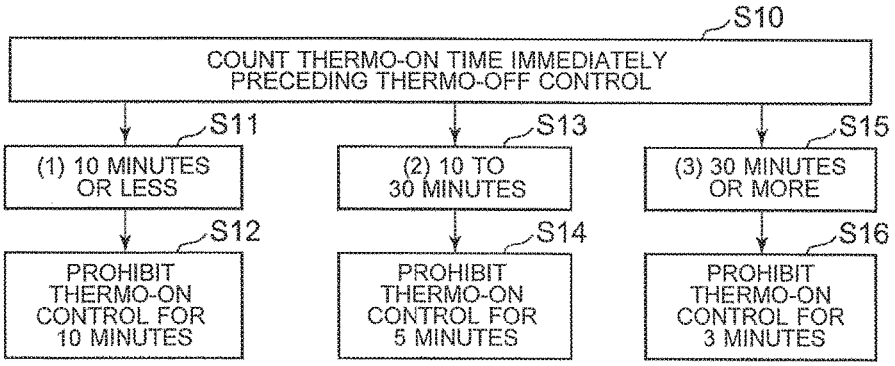
FIG. 4 illustrates characteristic control actions of the air-conditioning apparatus.

Thus, the following description of Embodiment 1 will be directed to a case in which, as illustrated in FIG. 4, the time period for which the next thermo-on control is prohibited (thermo-on prohibition time) is set depending on the thermo-on time immediately preceding the thermo-off control. Such control is executed by the function of the CPU.

First, the thermo-on time counting unit 41 of the CPU causes the timer T to count the continuous thermo-on time immediately preceding the thermo-off control (step S10). When the thermo-on time immediately preceding the thermo-off control counted in step S10 is 10 minutes or less (step S11), the CPU regards the thermal load to be small, and prohibits the thermo-on control for 10 minutes (step S12). Then, the first compressor forced-stop unit 47 disables the compressor 21 from being started by the compressor control unit 45 throughout the duration of the thermo-on prohibition time Pn set by the first thermo-on prohibition time setting unit 46. When the thermo-on time immediately preceding the thermo-off control counted in step S10 is in the range of 10 to 30 minutes (step S13), the CPU prohibits the thermo-on control for 5 minutes (step S14), and disables starting of the compressor 21 during that time period. When the thermo-on time immediately preceding the thermo-off control counted in step S10 is 30 minutes or more (step S15), the CPU regards the thermal load to be normal and prohibits the thermo-on control for only 3 minutes (normal operation) (step S16), and disables starting of the compressor 21 during that time period. That is, the first thermo-on prohibition time setting unit 46 sets the next thermo-on prohibition time Pn corresponding to the thermo-on time counted by the thermo-on time counting unit 41, by reading this value from the memory M.

The thereto-on prohibition is cleared when the temperature rises by a predetermined value (for example, 1 degree C.) from the suction temperature of the air-conditioning apparatus at the thermo-off control. The thermo-on prohibition can be also cleared when an external operation signal (forced thermo-on command signal) is input. The thermo-on prohibition time mentioned above may not necessarily be fixed to a specific numerical value but may be set to any time period of 3 minutes or more.

As described above, the air-conditioning apparatus 100 according to Embodiment 1 sets the thermo-on prohibition time Pn for which the next thermo-on control is prohibited, based on the thermo-on time Po immediately preceding the thermo-off control. This configuration prevents the compressor 21 from not starting (the thermo-on control is not performed) for a long time even when the immediately preceding thermo-on time Pc is short, that is, even when the actual air conditioning load is low or even when the exhaust heat from heat-generating devices located in the air-conditioned indoor space is not returned to the indoor unit 1, and also reduces the number of times the compressor 21 is started and stopped. Further, when the immediately preceding thermo-on time Po is long, that is, when the air conditioning load is high, the thermo-on prohibition time Pn can be minimized, thus allowing the compressor 21 to be started as early as possible.

Embodiment 2

Figure 5:
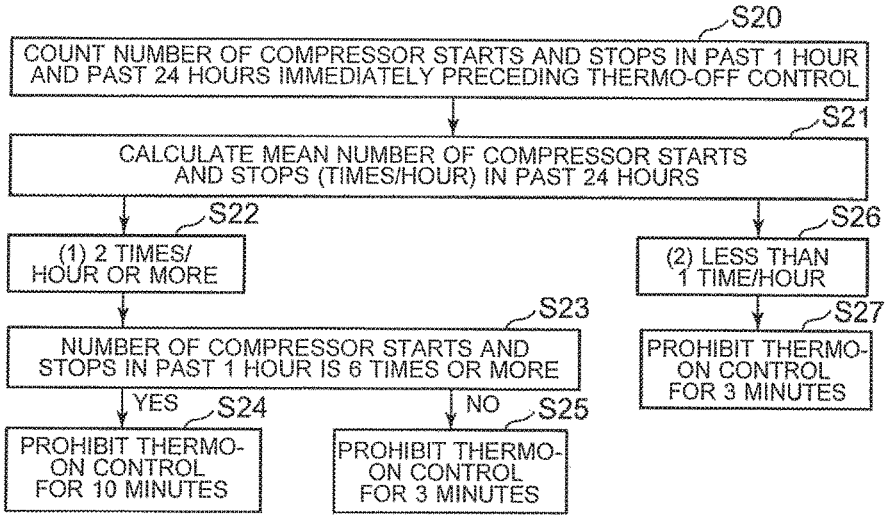
FIG. 5 illustrates characteristic control actions of an air-conditioning apparatus according to Embodiment 2 of the present invention.

In Embodiment 1, the time period for which the next thermo-on control is prohibited is set based on the thermo-on time immediately preceding the thermo-off control. Next, Embodiment 2 will be described in which the thermo-on prohibition time is set based on the number of compressor starts and stops that have occurred in the past. FIG. 5 illustrates Embodiment 2 in which the thermo-on prohibition time is set based on the number of compressor starts and stops that have occurred in the past.

First, the compressor start-stop counting unit 42 of the CPU counts the number of compressor starts and stops that have occurred in the past 1 hour and 24 hours immediately preceding the thermo-off control (step S20). Next, the CPU calculates, from the number of compressor starts and stops counted in step S20, the mean number of compressor starts and stops (times/hour) that have occurred in the past 24 hours (step S21). When the mean number of compressor starts and stops calculated in step S21 is 2 times/hour or more (step S22), the CPU determines whether the number of compressor starts and stops that have occurred in the past 1 hour is 6 times or more (step S23). When the number of compressor starts and stops is 6 times or more (Yes), the second thermo-on prohibition time setting unit 46 sets a thermo-on prohibition time of 10 minutes (step S24). Then, the second compressor forced-stop unit 47 disables the compressor 21 from being started by the compressor control unit 45 throughout the duration of the thermo-on prohibition time Pn (10 minutes in this case) set by the second thermo-on prohibition time setting unit 46. When the number of compressor starts and stops is less than 6 times (No) in step S23, the CPU sets a thermo-on prohibition time of only 3 minutes (normal operation) (step S25), and disables starting of the compressor 21. When the mean number of compressor starts and stops calculated in step S21 is less than 2 times/hour (step S26), the CPU sets a thermo-on prohibition time of only 3 minutes (normal operation) (step S27), and disables starting of the compressor 21. That is, the second thermo-on prohibition time setting unit 46 mentioned above has the function of setting the next thermo-on prohibition time Pn corresponding to the number of starts and stops counted by the compressor start-stop counting unit 42, by reading this value from the memory M.

The thermo-on prohibition is cleared when the temperature rises by predetermined temperature (for example, 1 degree C.) from the suction temperature of the air-conditioning apparatus at the thermo-off control. The thermo-on prohibition can be also cleared when an external operation signal (forced thermo-on signal) is input. The thermo-on prohibition time may be set to any time period of 3 minutes or more.

As described above, the air-conditioning apparatus 100 according to Embodiment 2 sets the thermo-on prohibition time Pn based on the number of starts and stops of the compressor 21 that have occurred in the past. This configuration allows the number of compressor starts and stops to be reduced with greater reliability than in Embodiment 1, not only based on the latest air conditioning load conditions but also for cases where the air conditioning load is low and the compressor 21 has been started and stopped a large number of times. That is, the compressor 21 can be prevented from not starting (the thermo-on control is not performed) for a long time even when the number of starts and stops of the compressor 21 in the past is large, that is, even when the actual air conditioning load is low or even when the exhaust heat from heat-generating devices located in the air-conditioned indoor space is not returned to the indoor unit 1. When the number of starts and stops of the compressor 21 in the past is small, that is, when the air conditioning load is high, the thermo-on prohibition time Pn can be minimized, thus allowing the compressor 21 to be started as early as possible.

Embodiment 3

Figure 6:
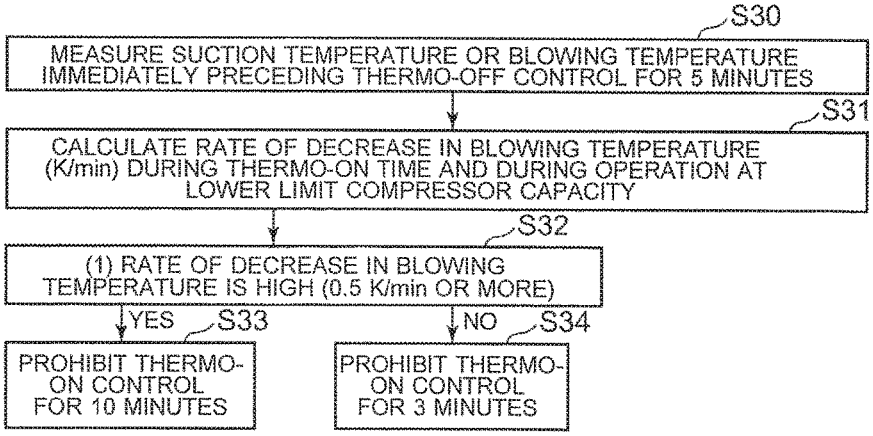
FIG. 6 illustrates characteristic control actions of an air-conditioning apparatus according to Embodiment 3 of the present invention.

In Embodiment 1, the time period for which the next thermo-on control is prohibited is set based on the thermo-on time immediately preceding the thermo-off control. Next, Embodiment 3 will be described in which the thermo-on prohibition time is set based on the blowing temperature immediately preceding the thermo-off control. FIG. 6 illustrates Embodiment 3 in which the thermo-on prohibition time is set based on the blowing temperature immediately preceding the thermo-off control.

First, the blowing temperature sensor 17 measures the blowing temperature for an interval of 5 minutes immediately preceding the thermo-off control (step S30). Next, in step S30, the blowing temperature decrease rate calculating unit 43 of the CPU calculates, from the blowing temperature measured for 5 minutes, the rate of decrease in blowing temperature (degrees K/min) during thermo-on time and during operation at the lower limit compressor capacity (step S31). Subsequently, the third thermo-on prohibition time setting unit 46 sets the next thermo-on prohibition time Pn corresponding to the rate of decrease in blowing temperature calculated by the blowing temperature decrease rate calculating unit 43, by reading this value from the memory M. That is, when the rate of decrease in blowing temperature calculated in step S31 is high (0.5 degrees K./min or more: Yes in step S32), the CPU prohibits the thermo-on control for 10 minutes (step S33), and disables starting of the compressor 21 during that time period. When the rate of decrease in blowing temperature calculated in step S31 is low (lower than 0.5 degrees K./min: No in step S32), the CPU prohibits the thermo-on control for only 3 minutes (normal operation) (step S34), and disables starting of the compressor 21 during that time period. Then, the third compressor forced-stop unit 47 disables the compressor 21 from being started by the compressor control unit 45 throughout the duration of the thermo-on prohibition time Pn set by the third thermo-on prohibition time setting unit 46.

As described above, the air-conditioning apparatus 100 according to Embodiment 3 sets the thermo-on prohibition time Pn for which the next thermo-on control is prohibited, based on the rate of decrease in blowing temperature immediately preceding the thermo-off control. In comparison to Embodiment 1, this configuration keeps accurate track of the latest load conditions, thus further enhancing the effects described below. First, the compressor 21 can be prevented from not starting (the thermo-on control is not performed) for a long time even when the rate of decrease in blowing temperature immediately preceding the thermo-off control is high, that is, even when the actual air conditioning load is low or even when the exhaust heat from heat-generating devices located in the air-conditioned indoor space is not returned to the indoor unit 1, and also the number of times the compressor 21 is started and stopped can be reduced. Further, even when the rate of decrease in blowing temperature immediately preceding the thermo-off control is low, that is, when the air conditioning load is slightly below the lower limit capability of the air-conditioning apparatus 100 (the capability at the lower-limit capacity of the compressor 21), the thermo-on prohibition time Pn can be minimized, thus allowing the compressor 21 to be started as early as possible after the thermo-off control is once effected.

Embodiment 4

In Embodiment 1, the time period for which the next thermo-on control is prohibited is set based on the thermo-on time immediately preceding the thermo-off control. Next, Embodiment 4 will be described in which the thermo-on prohibition time is set based on the rate of increase in suction temperature during thermo-off time.

Figure 7:
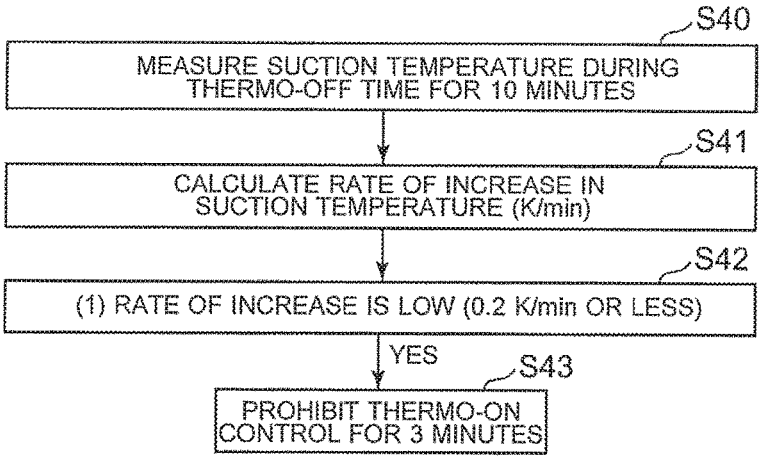
FIG. 7 illustrates characteristic control actions of an air-conditioning apparatus according to Embodiment 4 of the present invention.

FIG. 7 illustrates Embodiment 4 in which the thermo-on prohibition time is set based on the rate of increase in suction temperature during thermo-off time.

First, the suction temperature sensor 16 detects the suction temperature of air sucked into the indoor unit 1 for an interval of 10 minutes during thermo-off time, and outputs the detected temperature to the CPU (step S40). Next, a suction temperature increase rate calculating unit 44 of the CPU calculates the rate of increase in suction temperature (degrees K/min) from the suction temperature detected for an interval of 10 minutes during thermo-off time by the suction temperature sensor 16 in step S40 (step S41). When the rate of increase calculated in step S41 is low (0.2 degrees K./min or less: Yes in step S42), thermo-on prohibition for only 3 minutes is started (normal operation) (step S43). That is, the fourth thermo-on prohibition time setting unit 46 of the CPU sets the next thermo-on prohibition time Pn corresponding to the rate of increase in suction temperature calculated by the suction temperature increase rate calculating unit 44, by reading this value from the memory M. Then, the fourth compressor forced-stop unit 47 of the CPU disables the compressor 21 from being started by the compressor control unit 45 throughout the duration of the thermo-on prohibition time Pn set by the fourth thermo-on prohibition time setting unit 46.

As described above, the air-conditioning apparatus 100 according to Embodiment 4 sets the thermo-on prohibition time Pn based on the rate of increase in suction temperature during thermo-off time. As a result, in comparison to Embodiments 1, 2, and 3, Embodiment 4 provides the effect that when the thermo-off time is long, and the air conditioning load increases rapidly, the thermo-off prohibition time Pn can be set approximately to the latest air conditioning load conditions.

Although the above embodiments are directed to an air-conditioning apparatus that cools the air-conditioned indoor space, the present invention is not limited to the embodiments. The present invention can also apply to an air-conditioning apparatus that heats the air-conditioned indoor space.

Although the control according to the present invention is performed by the indoor control device 14 of the indoor unit 1 in the foregoing description, the control may be performed by the outdoor control device 23 of the outdoor unit 2, or by the outdoor control device 23 and the indoor control device 14 acting in cooperation with each other.

REFERENCE SIGNS LIST

1 indoor unit 2 outdoor unit 3 connecting pipe 12 use-side heat exchanger 13 indoor air-sending unit 14 indoor control device 15 expansion valve 16 suction temperature sensor 17 blowing temperature sensor 21 compressor 22 heat source-side heat exchanger 23 outdoor control device 24 outdoor air-sending unit 40 predetermined-device control unit 41 thermo-on time counting unit 42 compressor start-stop counting unit 43 blowing temperature decrease rate calculating unit 44 suction temperature increase rate calculating unit 45 compressor control unit 46 first to fourth thermo-on prohibition time setting unit 47 first to fourth compressor forced-stop unit 100 air-conditioning apparatus 200 refrigerant circuit M memory Pn thermo-on prohibition time Po thermo-on time T timer

The invention claimed is:

1. An air-conditioning apparatus comprising:

a refrigerant circuit sequentially annularly connecting a compressor, a heat source-side heat exchanger, an expansion valve, and a use-side heat exchanger;

a blowing temperature sensor configured to detect a blowing temperature of air, the air being blown out into an air-conditioned indoor space after passing through the use-side heat exchanger in an indoor unit in which the use-side heat exchanger is disposed;

a compressor control unit configured to perform thermo-on control to start the compressor, and thermo-off control to stop the compressor, to approximate the blowing temperature detected by the blowing temperature sensor to a preset temperature;

a thermo-on time counting unit configured to count thermo-on time during which the thermo-on control is continuously performed immediately preceding the thermo-off control;

a first thermo-on prohibition time setting unit configured to, based on the thermo-on time counted by the thermo-on time counting unit, calculate and set a thermo-on prohibition time for which the next thermo-on control is prohibited; and a first compressor forced-stop unit configured to disable the compressor from being started by the compressor control unit during the thermo-on prohibition time set by the first thermo-on prohibition time setting unit.

2. The air-conditioning apparatus of claim 1, further comprising:

a blowing temperature decrease rate calculating unit configured to calculate a rate of decrease of the blowing temperature detected by the blowing temperature sensor in a predetermined time period immediately preceding the thermo-off control;

a third thermo-on prohibition time setting unit configured to, based on the rate of decrease of the blowing temperature calculated by the blowing temperature decrease rate calculating unit, calculate and set a thermo-on prohibition time for which the next thermo-on control is prohibited; and a third compressor forced-stop unit configured to disable the compressor from being started by the compressor control unit during the thermo-on prohibition time set by the third thermo-on prohibition time setting unit.

3. The air-conditioning apparatus of claim 1, further comprising:

a suction temperature sensor configured to detect a suction temperature of air sucked into the indoor unit;

a suction temperature increase rate calculating unit configured to calculate a rate of increase of the suction temperature detected by the suction temperature sensor in a predetermined time period during which the thermo-off control is continuously performed;

a fourth thermo-on prohibition time setting unit configured to, based on the rate of increase of the suction temperature calculated by the suction temperature increase rate calculating unit, calculate and set a thermo-on prohibition time for which the next thermo-on control is prohibited; and a fourth compressor forced-stop unit configured to disable the compressor from being started by the compressor control unit during the thermo-on prohibition time set by the fourth thermo-on prohibition time setting unit.

4. An air-conditioning apparatus comprising:

a refrigerant circuit sequentially annularly connecting a compressor, a heat source-side heat exchanger, an expansion valve, and a use-side heat exchanger;

a blowing temperature sensor configured to detect a blowing temperature of air, the air being blown out into an air-conditioned indoor space after passing through the use-side heat exchanger in an indoor unit in which the use-side heat exchanger is disposed;

a compressor control unit configured to perform thermo-on control to start the compressor, and thermo-off control to stop the compressor, to approximate the blowing temperature detected by the blowing temperature sensor to a preset temperature;

a compressor start-stop counting unit configured to count a number of starts and stops of the compressor having occurred in a plurality of predetermined time periods in past;

a second thermo-on prohibition time setting unit configured to, based on the number of starts and stops counted by the compressor start-stop counting unit, calculate and set a thermo-on prohibition time for which the next thermo-on control is prohibited; and a second compressor forced-stop unit configured to disable the compressor from being started by the compressor control unit during the thermo-on prohibition time set by the second thermo-on prohibition time setting unit.

* * * * *